United States Patent [19]

Vucevic

[11] Patent Number: 4,696,196

[45] Date of Patent: Sep. 29, 1987

[54] STABILIZED PLATFORM ARRANGEMENT

[75] Inventor: Svet O. Vucevic, Chelmsford, England

[73] Assignee: Marconi International Marine Company Limited, Stanmore, England

[21] Appl. No.: 858,717

[22] Filed: May 2, 1986

[30] Foreign Application Priority Data

May 28, 1985 [GB] United Kingdom ..... 8513372

[51] Int. Cl.[4] ..... H01Q 1/18

[52] U.S. Cl. ..... 74/5.22; 74/5.34; 343/765

[58] Field of Search ..... 74/5.34, 5.22; 33/321; 343/765

[56] References Cited

U.S. PATENT DOCUMENTS

| | | | |
|---|---|---|---|
| 4,118,707 | 10/1978 | Yoshida et al. | 33/321 X |
| 4,209,789 | 6/1980 | Snedkerud | 343/765 |
| 4,399,714 | 8/1983 | Barker | 74/5.34 X |
| 4,433,337 | 2/1984 | Smith et al. | 343/765 |
| 4,442,435 | 4/1984 | Kiryu et al. | 33/321 X |
| 4,582,291 | 4/1986 | Matthews | 33/321 X |
| 4,596,989 | 6/1986 | Smith et al. | 33/321 X |

FOREIGN PATENT DOCUMENTS

| | | |
|---|---|---|
| 1499928 | 2/1978 | United Kingdom . |
| 1581540 | 12/1980 | United Kingdom . |

*Primary Examiner*—Rodney H. Bonck
*Attorney, Agent, or Firm*—Spencer & Frank

[57] ABSTRACT

A stabilized platform which is suitable for stabilizing the bore-sight of a communications antenna or the like, is provided with a pendulous mounting which holds the structure erect. A pair of gyroscopes give active control of the attitude of the platform, and are coupled to the platform via a gear arrangement. When the platform is rotated rapidly (to unravel feed cables or to permit overhead tracking of the antenna) the gyroscopes experience a much lesser degree of movement which is determined by the gearing ratio, such that the gyroscopes are not destabilized.

4 Claims, 2 Drawing Figures

STABILIZED PLATFORM ARRANGEMENT

BACKGROUND OF THE INVENTION

This invention relates to a stabilised platform arangement which is suitable for use with a body which is movable in a random or largely unpredictable manner, such as is the case with a ship. In such an application, the platform can provide a frame of reference for the boresight direction of an antenna in which the effect of pitch and/or roll of the ship is reduced. If an antenna forms part of a communications network employing satellite repeater stations, it is very important for the bore-sight direction of the antenna to be accurately aligned with the position of the satellite, as the directional beam sensitivity pattern of the satellite or the ship-borne antenna may have a very narrow angle in order to give sufficient signal gain. Pointing errors of the ship-borne antenna can impair or prevent reliable communications. Thus it is necessary for the antenna to be correctly orientated with respect to a distant satellite whilst the satellite itself may traverse an arc of space, even though the ship may pitch and roll in heavy seas.

Stabilisation systems using full servo controlled gyroscopic mechanisms are bulky, complex and expensive, and it has been proposed to mount such an antenna on a platform whose orientations and attitude are stabilised by means of a pendulously mounted gyroscopic assembly. The pendulous nature of the mounting provides a vertical reference line which is actively maintained by a fairly simple gyroscopic assembly which is operative to generate damped restoring forces inhibiting pendulous oscillations. From time to time, however, it can be necessary to rapidly rotate in azimuth the platform on which an antenna is mounted, particularly if an antenna has only limited elevational freedom of movement and is required to continuously track a satellite which passes overhead. There comes a point at which the maximum elevation of the antenna is reached, and an extremely rapid azimuth rotation of the antenna is required if it is to continue correctly tracking the satellite. A rapid azimuth rotation of the gyroscopic assembly can destabilise it, and it may take some considerable time to regain full control of the attitude of the antenna. Uncoupling the gyroscopic assembly from the platform during this period gives rise to difficult mechanical constructions, and makes it difficult for the gyroscopic assembly to properly recommence operation.

The present invention seeks to provide an improved stabilised platform arrangement.

SUMMARY OF THE INVENTION

According to a first aspect of this invention a stabilised platform arrangement includes a pendulous structure comprising a platform and a gyroscopic assembly operative to urge the pendulous arangement to its stable rest position, and coupling means operative to couple the gyroscopic assembly to the platform, such that rapid azimuth rotation of the platform causes a slower degree of azimuth rotation of the gyroscopic assembly.

According to a second aspect of this invention, a stabilised platform arrangement includes a platform pivotally mounted on a support by means of a universal joint; a gyroscopic assembly including a pair of gyroscopic rotors, each of which is mounted for rotation about respective axes which are mutually non-parallel, the assembly being linked to the platform so that the assembly and the platform together constitute a pendulous structure having a centre of gravity below the axes of the universal joint; and coupling means for coupling azimuth rotation of the gyroscopic assembly to that of the platform, the coupling means being geared such that a given angular movement of the platform in azimuth causes a lesser corresponding angular movement of the gyroscopic assembly.

Preferably the platform is of the kind which carries an antenna which is movable in elevation with respect to the platform. Preferably again, the platform, and the gyroscopic assembly are mounted and coupled such that the platform resists azimuth rotational forces applied by the gyroscopic assembly. When the gyroscopic assembly is operative to apply corrective forces to compensate for pitch and roll, it utilises the reaction exerted by the platform in order to impart the required angular forces upon the pendulous structure as a whole. The use of a gear ratio which is such that the gyroscopic assembly does not suffer excessive azimuth rotational forces also has the property of causing the assembly to thereby experience the required reaction forces. In this way, the gyroscopic assembly does not itself simply turn in azimuth when it attempts to exert corrective forces upon the platform.

BRIEF DESCRIPTION OF THE DRAWINGS

The invention is further described by way of example, with reference to the accompanying drawings, in which.

DESCRIPTION OF THE PREFERRED EMBODIMENTS

Figure 1:
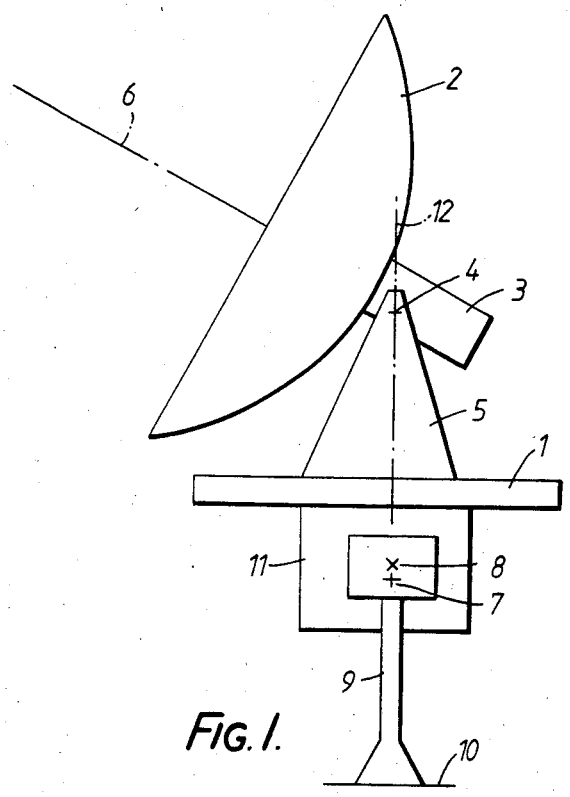
FIG. 1 illustrates a stabilised platform arrangement in accordance with the invention in a simplified manner.

Referring to FIG. 1, there is shown therein a platform 1 upon which is mounted an antenna 2 having a counterweight 3, which is pivotally mounted at an axis 4 in a frame 5 which permits the antenna to be steered in elevation. The frame 5 is rigidly mounted on the platform 1.

In order to control the pointing direction of the antenna 2, which is defined by its bore-sight axis 6, the antenna is tilted in elevation about the axis 4 and is correctly aligned in azimuth by rotation of the platform 1. The platform 1 rotates in an azimuth plane only if it is held perpendicular to the vertical axis 12, and this is partially achieved by arranging that its effective centre of gravity 7 is below the axes of a universal joint 8 which secures the assembly to a support pillar 9 which is mounted typically upon the deck 10 of a ship. In practice, the joint 8 could be a double gimbal device. Thus as the ship pitches and rolls, so the pillar 9 moves over a corresponding angular arc and the platform 1 is held approximately in a horizontal plane. The necessary relative motion between the platform 1 and the pillar 9 is permitted by the universal joint 8, and the position of the centre of gravity 7 ensures a pendulous action which holds the antenna assembly erect under the effect of gravity.

However, it will be appreciated that if the centre of gravity 7 is too far below the pivot axes of the joint 8, acceleration forces caused by the translational forces of the pitch and roll motions will cause excessive tilting of the antenna assembly, whereas if the centre of gravity is too high, the period of oscillation of the pendulous structure will be long, requiring a considerable period of time to elapse before the antenna returns to its correct angular position in elevation.

A gyroscopic assembly 11 is provided which is coupled to the platform 1 and to the universal joint 8. It acts to resist angular movement of the platform 1 about the pitch and roll axes, and is operative to restore the axis 12 of the antenna assembly as a whole to its nominal vertical position without permitting undue oscillation of the pendulous structure to occur. In order to provide correcting moments in both pitch and roll planes, two separate gyroscopic rotors, not shown, are carried by the gyroscopic assembly 11, it being ensured that the axes of the two rotors are off-set from each other so that there is always at least one rotor which is subject to a force causing a change of its axis in space whenever a pitch or roll motion is encountered. The rotor may rotate about vertical or horizontal axes, or even intermediate axes. The use of two rotors having non-parallel axes in a pendulous gyroscopic assembly is itself known.

The action of the gyroscopic structure 11 in exerting restoring moments to the platform 1 is to exert also a rotational force about the axis 12 of rotation of the platform 1, and if this were allowed to result in rotational movement of the assembly, its effect would be largely negated. To prevent this happening, the assembly 11 is coupled to the platform 1 by means of a gear-box having high ratio gearing.

Figure 2:
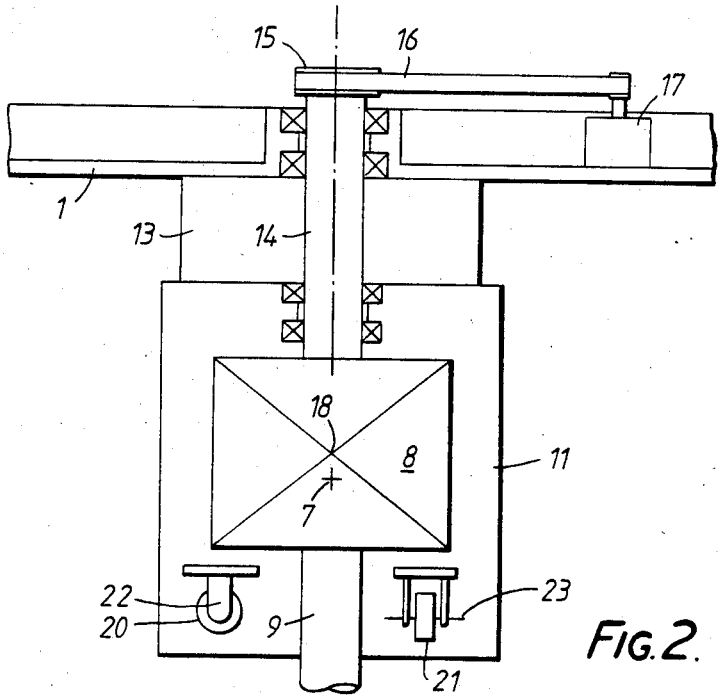
FIG. 2 illustrates a portion thereof in greater detail.

The effect and disposition of the gear-box are illustrated with greater clarity in FIG. 2, in which, so far as possible, the same reference numerals are adopted as in FIG. 1.

Referring to FIG. 2, it will be seen that the support 9 carries the universal joint 8 having axes at point 18 which are somewhat above the centre of gravity 7 of the entire structure which is supported by the support 9, this structure comprising the antenna 2, the platform 1, the gyroscopic assembly 11 and a gear-box 13. In the drawing, the axis 12 is shown aligned with the support 9, but unless the support 9 is exactly vertical (i.e., not experiencing pitch or roll), the two will be angularly offset from each other. In this figure, the two rotors 20 and 21 of the gyroscopic assembly 11 are illustrated in a diagramatic fashion. They are rotated by motors (i.e not) shown) about respective axes 22, 23 which in this example are mutually perpendicular, but which in the general case need to be merely non-parallel.

The platform 1 is rotated about a shaft 14, which is linked by the universal joint 8 to the support pillar 9, but which is arranged so that it is not rotatable about its own axis with respect thereto. The shaft 14 carries a pulley wheel 15 which is linked via a belt 16 to a stepper motor 17. Operation of the stepper motor 17 causes movement of the belt 16, thereby causing rotation of the platform and the antenna 2 about the shaft 14.

From time to time it is necessary to rotate the platform 1 very rapidly in azimuth. This requirement can arise if the antenna 2 traverses several complete revolutions in tracking a distant satellite for example, thereby causing its connecting cables to wrap themselves around the shaft 14. In this instance, a reverse rotation is required to unravel the cables and it should be rapid to minimise the time for which normal operation of the antenna is suspended. The antenna 2 may be such that it has only a limited angle of elevation movement, normally a little in excess of 90°. As it tracks a satellite moving directly overhead there comes a point at which its elevation angle cannot be increased further When this point is reached, it is necessary for the platform 1 and antenna 2 to rotate very rapidly so that the boresight 6 can regain the satellite and progressively reduce the angle of elevation as it continues to track the satellite.

It is found that a rapid rotation of the platform 1 can completely destabilise the gyroscopic structure 11 if that structure experiences the same rapid rotation. Accordingly, the high ratio gear-box 13 is provided, and its coupling is such that considerable movement of the platform 1 in azimuth produces only a small angular rotation of the structure 11, this movement of structure 11 being so small and so slow as not to cause any significant destabilisation of the gyroscopic rotors. Any small destablisation which may occur will be well within the capability of the gyroscopic structure to restore. The use of the high ratio gear-box 13 has the advantage that the gyroscopic structure 11 is still firmly linked to the platform 1 and the stepper motor drive 17, so that when the gyroscopic structure 11 exerts restoring moments to compensate for pitch and roll motions, the platform 1 exerts a suitable reaction force. The gyroscopic structure 11 is unable to rotate the platform 1 in azimuth, it lacking the sufficient torque to do so, and the nature of the stepping motor 17 is chosen to enhance the resistance of the platform 1 to externally applied azimuth rotational forces.

The use of the high ratio gear-box 13 provides a relatively simple and permanent coupling between the gyroscopic structure 11 and the platform 1 avoiding any need to peridocially engage and disengage any coupling therebetween, with the attendant destabilisation problems. The use of the gear-box 13 for which a gear ratio of about 10 to 1 is suitable, enables the gyroscopic structure 11 to always be in a position to exert a correcting influence upon the platform 1, yet it is such that it is not adversly effected by rapid azimuth movements of the platform 1 itself.

What is claimed is:

1. A stablished platform arrangement including a platform mounted on a support by means of a universal joint; a gyroscopic assembly including a pair of gyroscopic rotors each of which is mounted for rotation about respective axes which are mutually non-parallel, the assembly being linked to the platform so that the assembly and the platform together constitute a pendulous structure having a centre of gravity below the axes of the universal joint; and gearing means for coupling azimuth rotation of the gyroscopic assembly to that of the platform, the gear ratio of said gearing means being such that a given angular movement of the platform in azimuth causes a lesser corresponding angular movement of the gyroscopic assembly.

2. An arrangement as claimed in claim 1 and in which the platform carries an antenna is movable in elevation with respect to the platform.

3. An arrangement as claimed in claim 1 and wherein the platform and the gyroscopic assembly are mounted and coupled such that the platform resists azimuth rotational forces applied by the gyroscopic assembly.

4. An arrangement as claimed in claim 1 and wherein the platform is coupled to the universal joint by a member which is not rotational in azimuth with respect to the joint, and which provides a reaction force for rotation of the platform in azimuth.

* * * * *